US005237916A

United States Patent [19]

Malashenko

[11] Patent Number: 5,237,916

[45] Date of Patent: Aug. 24, 1993

[54] REGENERATIVE HYDRAULIC CYLINDERS WITH INTERNAL FLOW PATHS

[75] Inventor: Leon Malashenko, Toronto, Canada

[73] Assignee: John T. Hepburn, Limited, Mississauga, Canada

[21] Appl. No.: 900,488

[22] Filed: Jun. 18, 1992

[51] Int. Cl.[5] ..... B30B 1/32; F01B 31/00

[52] U.S. Cl. ..... 100/269 R; 72/453.12; 91/422; 92/181 P; 425/451.2; 425/450.1

[58] Field of Search ..... 100/269 R; 72/453.12; 425/450.1, 451.2; 91/422; 92/181 R, 181 P; 251/325

[56] References Cited

U.S. PATENT DOCUMENTS

| | | | |
|---|---|---|---|
| 2,711,797 | 6/1955 | Muller | 91/422 X |
| 3,700,765 | 10/1972 | Aoki | 425/450.1 X |
| 3,818,801 | 6/1974 | Kime | 91/422 X |
| 4,021,181 | 5/1977 | Hehl | 425/450.1 |
| 4,105,385 | 8/1978 | Hehl | 425/450.1 X |
| 4,258,609 | 3/1981 | Conway | 91/422 X |
| 4,375,181 | 3/1983 | Conway | 91/422 X |
| 4,953,458 | 9/1990 | Day | 100/269 R |

FOREIGN PATENT DOCUMENTS

| | | | |
|---|---|---|---|
| 187930 | 2/1964 | Sweden | 100/269 R |

*Primary Examiner*—Stephen F. Gerrity
*Attorney, Agent, or Firm*—Mirek A. Waraksa

[57] ABSTRACT

A regenerative hydraulic cylinder has a piston dividing its interior into a pair of chambers. A rod extends from the piston through a cylinder end wall. Several axial passages in the piston extend between opposite piston faces. A valve member is mounted over one piston face and has a sleeve that slides axially in a recess formed in the one piston face. Springs urge the valve member to a flow-impeding orientation against the piston face. A hydraulic pilot line in the rod, accessible at an external rod end, permits the valve member to be displaced away from the piston face to a flow-enabling orientation. The valve state is controlled to permit fluid flow directly between chambers during extension or contraction of the cylinder.

12 Claims, 6 Drawing Sheets

REGENERATIVE HYDRAULIC CYLINDERS WITH INTERNAL FLOW PATHS

FIELD OF THE INVENTION

The invention relates generally to hydraulic cylinders, and, more specifically, to reduction of fluid flows to and from cylinder chambers.

BACKGROUND OF THE INVENTION

The invention has general application to the construction of hydraulic cylinders. However, a particular application relates to large pull-down presses. Such presses generally have a frame, a lower platen fixed to the frame, and an upper displaceable platen. Two or more hydraulic cylinders may displace the upper platen between an upper retracted position in which work pieces can be removed from or placed between the platens and a lower operative position in which a work piece can be compressed between the platens. Each hydraulic cylinder contains a piston that divides the interior of its housing into upper and lower chambers. One chamber discharges hydraulic fluid to a reservoir whenever the other chamber expands under pressurized fluid flows from a pump. During actual compression phases of operation, very little hydraulic fluid may flow to or from the chambers. However, during rapid advancing and retraction of the upper platen to and from its lower operative position, flow rates approaching 5000 liters per minute would not be uncommon in large-scale presses, if reasonable press cycle times are to be maintained. Conduits and flow valves must be appropriately sized to accommodate such flow rates.

Techniques are known for more direct transfer of hydraulic fluid between cylinder chambers and are commonly referred to as "regeneration". Regeneration has generally required a flow circuit external to a hydraulic cylinder and external flow gating valves. A recent proposal suggests that the regenerative flow path and valves may be formed within the cylinder itself. The cylinder rod is formed with a hollow interior that communicates through ports with the chamber at the rod end of the cylinder. A hollow tube is fixed to the base or blind end of the cylinder and extends in telescopic relationship through the cylinder piston and the interior of the cylinder rod. A short passage formed in the base of the cylinder places the hollow tube in communication with the lower chamber. The rod, tube, and passage together define a complete internal flow path between the upper and lower chambers. A valve mounted in the base of the cylinder, specifically in the short flow passage in the base, controls fluid flows. The valve is configured to open in response to pressure within the flow path, allowing direct flows between cylinder chambers. Hydraulic pressure along a pilot line through the base of the cylinder closes the valve, isolating the chambers. Regeneration can be achieved both during extension and contraction of the cylinder. However, the telescopic mounting of the hollow tube introduces considerable complexity, and necessarily reduces the effective cross-sectional piston area responsive to pressure during cylinder extension.

SUMMARY OF THE INVENTION

In one aspect, the invention provides a hydraulic cylinder comprising a housing and a piston and rod assembly. The assembly includes a piston displaceable within the interior of the housing and a rod fixed to the piston. The piston divides the interior of the housing into a pair of chambers. Fluid ports in the housing permit access to the chambers from externally of the cylinder. A flow passage is formed in the piston and extends between the opposing faces of the piston. Valve means attached to and displaceable with the piston and rod assembly control fluid flow between the cylinder chambers along the flow path. Means are provided for controlling the open or closed state of the valve means. The control means extend from the valve means through the piston and rod assembly to a rod portion external to the housing, such that the control means are operable from externally of the housing. The control means may comprise a solenoid electrically-operable with conductors extending through the piston rod. However, a hydraulic pilot line is preferred. Both the open and closed states of the valve means may be externally controlled, but the valve means may be configured to close inherently in response to chamber pressure or may be spring-biased to a closed state.

In another aspect, the invention provides a press comprising a frame, a lower platen fixed relative to the frame, and a movable upper platen. A plurality of hydraulic cylinders are provided to displace the upper platen. Each hydraulic cylinder comprises a housing fixed to the frame or the lower platen. Each comprises a piston and rod assembly including a piston dividing the interior of its housing into upper and lower chambers, and a rod fixed to and extending upwardly from the piston. The rod comprises an upper rod portion external to the housing and attached to the upper platen. Upper and lower fluid ports access the upper and lower chambers. A flow passage is formed in the piston and extends between upper and lower piston faces. Valve means attached to and displaceable with the piston and rod assembly control fluid flow along the flow passage. The valve means have an open state permitting fluid flow along the passage and a closed state impeding such fluid flow. Each hydraulic cylinder also comprises control means for controlling the state of its valve means. The control means extend form the valve means through the piston and rod assembly to the external rod portion such that the control means are operable from externally of the housing. The press includes a reservoir containing hydraulic fluid, and means coupled to the reservoir for producing hydraulic fluid under pressure. Fluid gating means can be controlled to assume at least first, second and third selectable modes of operation. In the first mode of operation, the fluid gating means couple the lower ports of the hydraulic cylinders to the reservoir and preferably impede all fluid to or from the upper chambers. In the first mode of operation, the valve means will assume an open state, and the upper platen will be allowed to descend under gravity. Hydraulic fluid is displaced largely between the upper and lower chambers, with some flow from the lower chambers to the reservoir. In the second mode of operation, the fluid gating means direct hydraulic fluid under pressure to the upper ports of the hydraulic cylinders and couple the lower ports to the reservoir. During this mode of operation, the valve means may assume a closed state, allowing compression of a work piece between the upper and lower platens. In the third mode of operation, the fluid gating means direct hydraulic fluid under pressure to the lower ports of the hydraulic cylinders and obstruct flows from the upper ports of the cylinders. In the third mode of operation, the valve means are placed in an open state, allowing fluid flow between the chambers, the upper platen being raised essentially by the net effect of pressure on the cross-sectional area of the piston rod.

Other aspects of the invention will be apparent from a description below of preferred embodiments and will be more specifically defined in the appended claims.

DESCRIPTION OF THE DRAWINGS

The invention will be better understood with reference to drawings in which.

DESCRIPTION OF PREFERRED EMBODIMENTS

Figure 1:
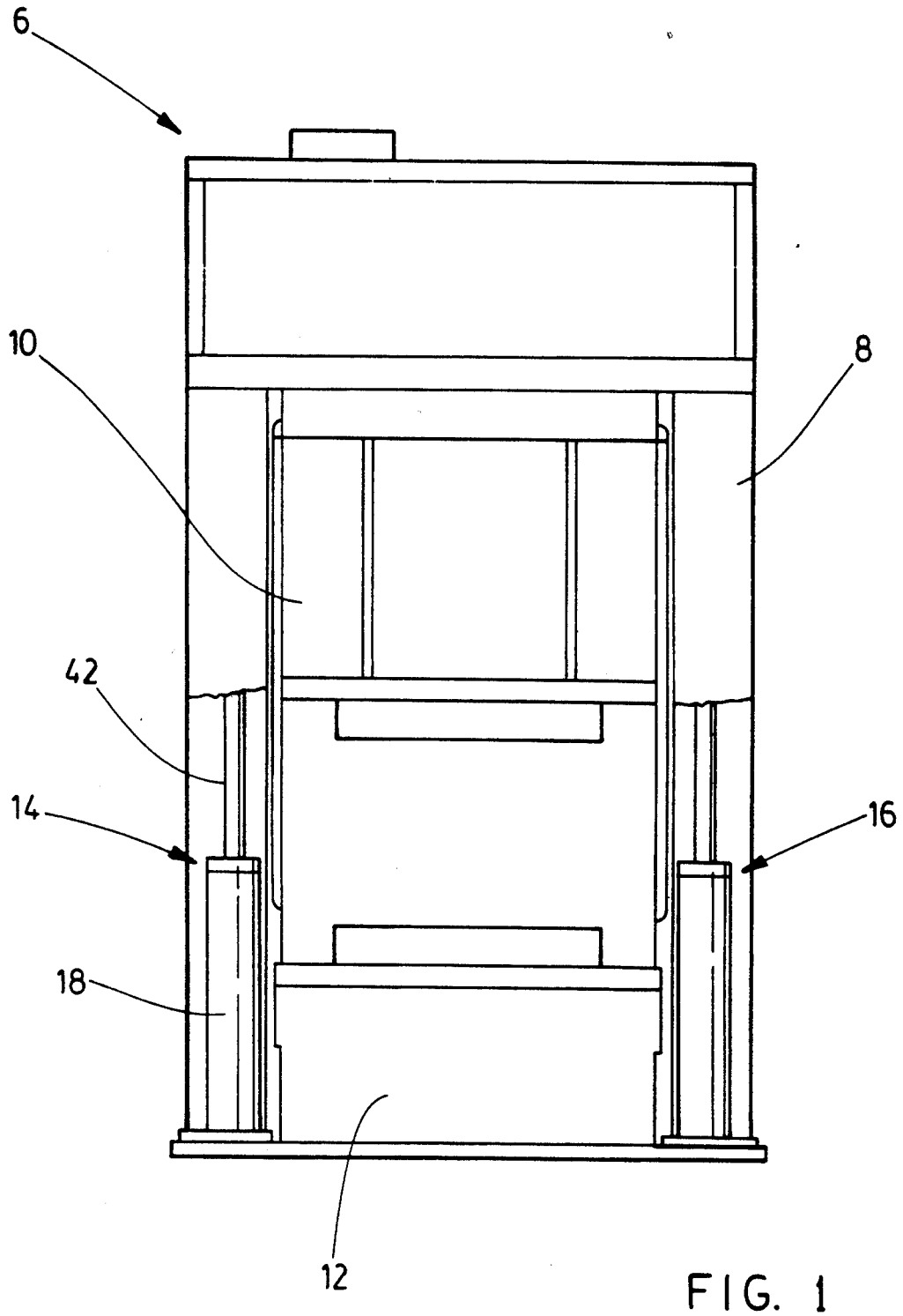
FIG. 1 is an elevational view of a pull-down press incorporating hydraulic cylinders embodying the invention.

Reference is made to FIG. 1 which illustrates a pull-down press 6. The press 6 comprises a conventional frame 8, an upper platen 10 displaceable on the frame 8 and a lower stationary platen 12 fixed to the frame 8. A pair of identical hydraulic cylinders 14, 16 are used to displace the upper platen 10.

The hydraulic cylinder 14, diagrammatically illustrated in FIGS. 2, 3*a*, 3*b* and 4, is typical. It has a housing 18 with a cylindrical side wall 20 and a pair of opposing end walls 22, 24. The housing 18 is fixed in a vertical orientation to the lower platen 12. A piston and rod assembly is mounted within the interior of the housing 18. The piston and rod assembly includes a piston 26 that divides the interior into upper and lower chambers 28, 30. Upper and lower fluid ports 32, 34 formed in the housing side wall 20 communicate with the two chambers 28, 30. The piston 26 has a cylindrical side wall 36 sealed in sliding relationship to the housing side wall 20, and upper and lower faces 38, 40 at the upper and lower chambers 28, 30. The piston and rod assembly includes a rod 42 whose lower end portion 44 is stepped-down, threaded and screwed into a threaded central passage 46 of the piston 26. A pin 48 inserted at the junction of the piston 26 and rod 42 prevents relative rotation of the two components. An upper end portion 50 of the rod 42 extends through the upper housing end wall 22 and is external to the housing 18. The external rod portion 50 is pivotally connected to the upper platen 10 in a conventional manner.

Eight circular flow passages 52 are formed in the piston 26. Each extends axially between the upper and lower piston faces 38, 40, opening to the upper and lower chambers 28, 30 at the piston faces 38, 40. A valve 54 attached to the piston and rod assembly controls fluid flow along the eight flow passages 52. The valve 54 includes a valve member 56 located in the upper chamber 28. The valve member 56 has a plate-like body portion 58 with a central opening, and a sleeve portion 62 surrounding the central opening and extending transversely from the body portion 58 toward the piston 26. The valve member 56 is mounted around the rod 42 with its sleeve portion 62 fitted slidably into a complementary recess 64 defined in the upper face 38 of the piston 26. This constrains the valve member 56 to displace along a lengthwise axis of the rod 42.

Figure 2:
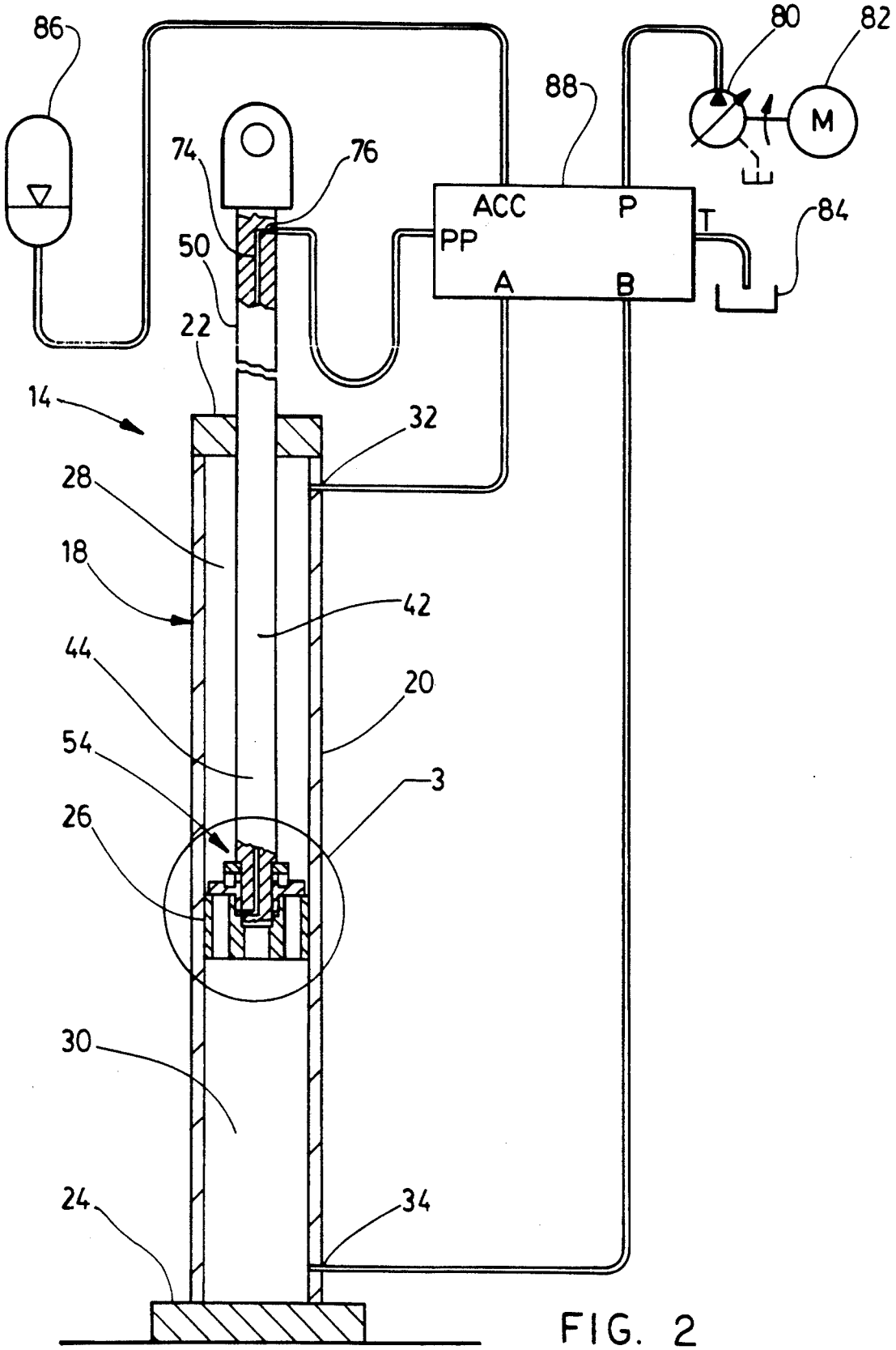
FIG. 2 is a diagrammatic view in partial cross-section of a hydraulic cylinder of the press and an associated hydraulic circuit.
Figure 3A:
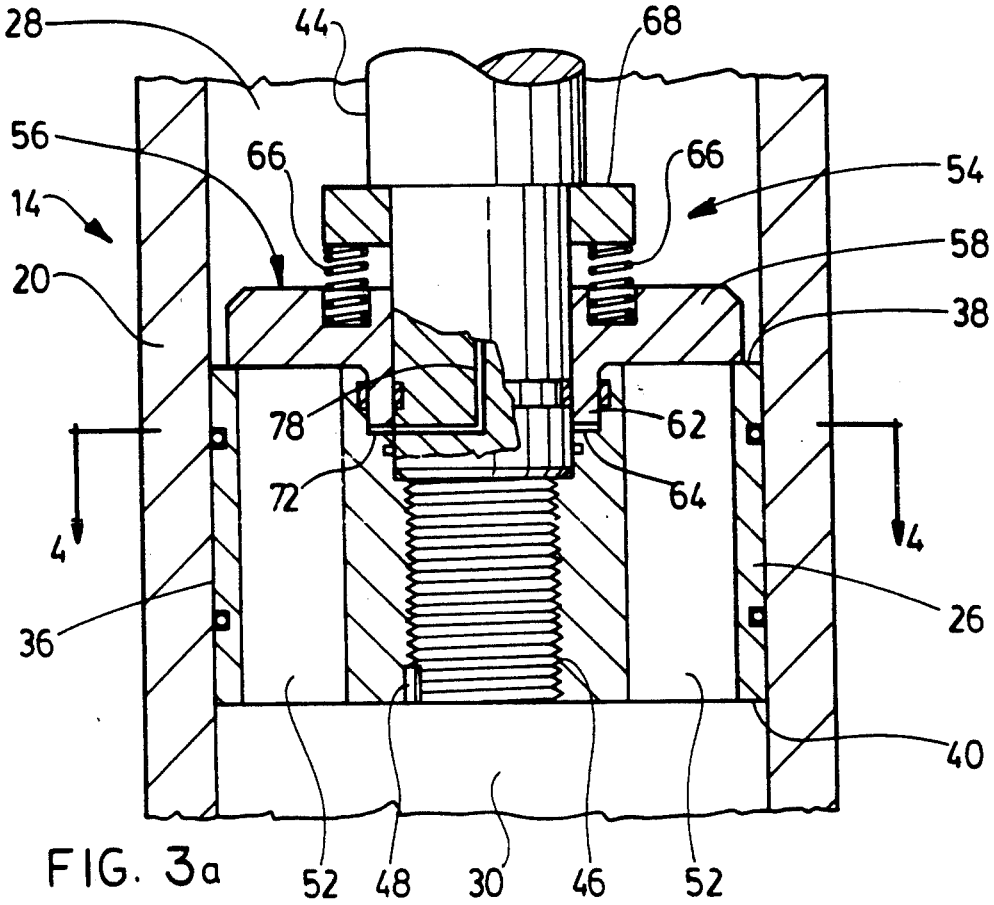
FIGS. 3*a* and 3*b* are enlarged views of the circled region 3 of FIG. 2 detailing a piston and internal valve with the valve respectively in closed and open states.
Figure 3B:
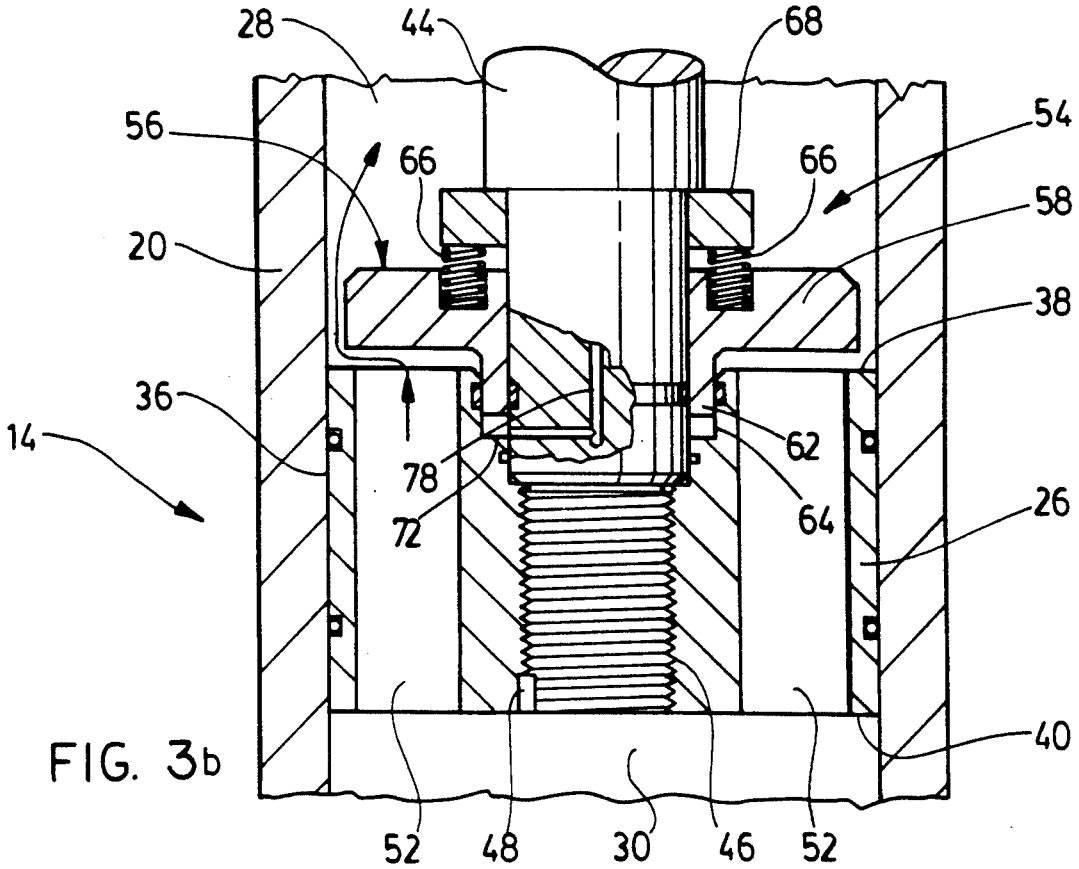
Figure 4:
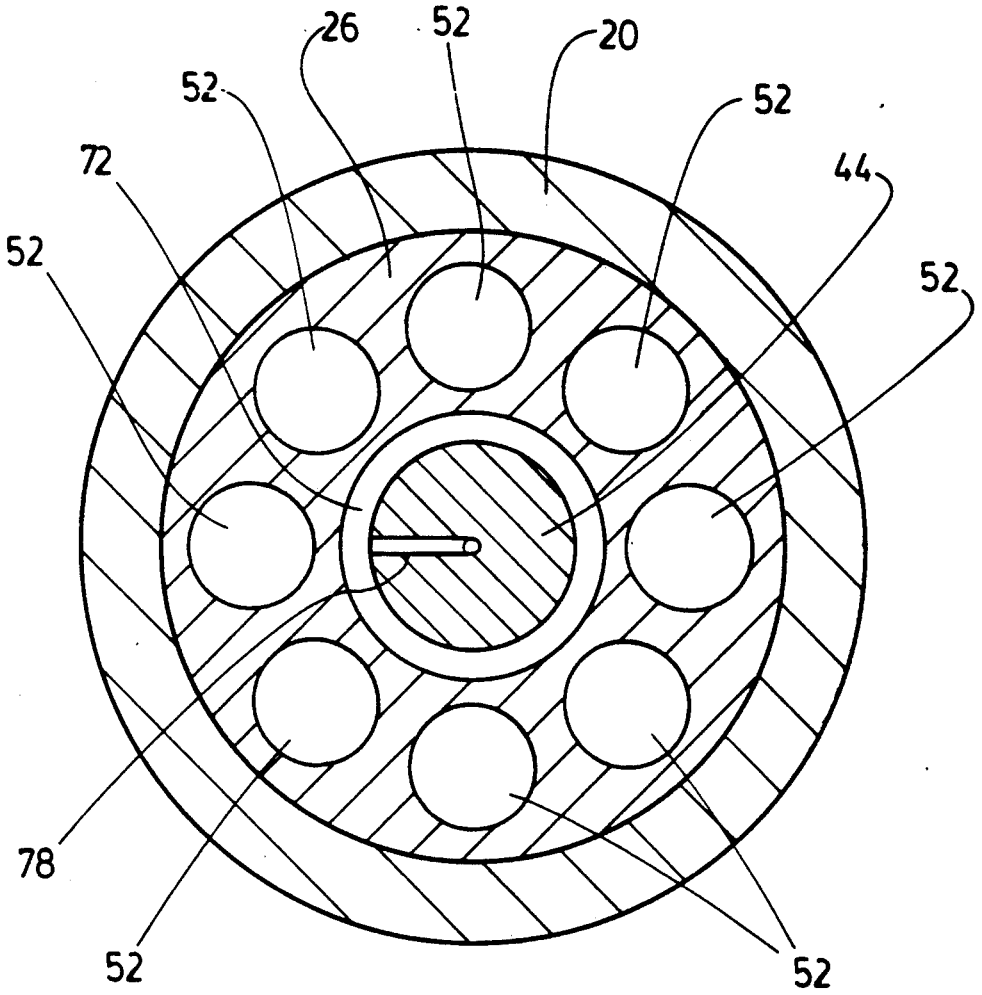
FIG. 4 is a view along lines 4—4 of FIG. 3*a;*

The valve member 56 has a flow-impeding orientation, shown in FIGS. 2 and 3*a*, in which the valve member 56 abuts the upper face 38 of the piston 26. It has a flow-enabling orientation, as illustrated in FIG. 3*b*, in which the valve member 56 is displaced from the upper piston face 38. Several rigid biasing springs 66 (only two apparent in FIGS. 3*a* and 3*b*) urge the valve member 56 towards its flow-disabling orientation. The springs 66 act between a circular abutment 68 fixed to the rod 42 and an upper surface of the body portion 58 of the valve member 56. The springs 66 are seated in wells formed in the upper surface of the body portion 58 to keep them properly positioned.

The valve member 56 can be hydraulically displaced to its flow-enabling orientation. The recess 64 seating the valve member 56 extends below the fully seated valve sleeve portion 62 to define an annular compartment 72 between an end face of the sleeve portion 62 distant from the body portion 58 and the rest of the piston body. A flow channel (pilot line) 74 for hydraulic fluid extends axially along the rod 42. The pilot line 74 has an inlet 76 located in the external rod portion 50 so that hydraulic fluid under pressure can be conveniently applied from externally of the housing 18. It has a lower end 78 which communicates with the compartment 72 formed below the valve member sleeve portion 62. The compartment 72 is appropriately sealed, as illustrated, and a flow of hydraulic fluid under pressure along the pilot line 74 displaces the valve member 56 to its flow-enabling orientation.

The press 6 comprises a pump 80 operated by an electric motor 82. The pump 80 is coupled to a fluid reservoir or tank 84 containing hydraulic fluid to produce a flow of hydraulic fluid under pressure. The pump 80 is operated in tandem with an accumulator 86, in a conventional manner. A flow gating valve 88 couples the various components to the hydraulic cylinder 14. Ports A and B of the flow gating valve 88 are connected respectively to the upper and lower ports 32, 34 of the cylinder 14. A port PP of the flow gating valve 88 is connected to the inlet 76 of the pilot line 74. The flow gating valve 88 has ports ACC, P and T connected respectively to the accumulator 86, the pump 80 and the tank 84. The valve 88 couples ports ACC and P to accumulate hydraulic fluid from the pump 80 within the accumulator 86. It can be operated to couple its port A or B to valve ports ACC and P, causing a pressurized flow to the upper or lower port 32 or 34 of the hydraulic cylinder 14. It can also be operated to couple its port A or B to its port T, as to discharge hydraulic fluid from either the upper or lower cylinder chamber 28 or 30 back to the tank 84. Alternatively, the valve 88 can obstruct fluid flow to or from either of its port A or port B, preventing fluid flow via external paths to or from either the upper or lower cylinder chambers 28 or 30. Similarly, the port PP can be coupled selectively to valve ports ACC and P to direct hydraulic fluid under pressure along the pilot line 74 to open the valve 54, or to port T to release pressure on the valve 54 to the tank 84, allowing the valve 54 to close under the influence of its biasing springs 66. The flow gating valve 88 is itself conventional, but its application to the press 6 in three distinct modes of operation is novel.

The first mode of operation occurs as the upper platen 10 is rapidly advanced in a downward direction towards the lower platen 12. The flow gating valve 88 couples the lower port 34 to the tank 84. It may optionally impede hydraulic fluid flow to or from the upper port 32 of the hydraulic cylinder 14 or allow the upper port 32 to be coupled to the tank 84. The platen 10 is allowed to descend under its own weight, creating pressure within the lower chamber 30 that causes the valve member 56 to displace to its flow-enabling orientation (open valve state). Alternatively, the valve 54 may be actively placed in its open state with hydraulic fluid under pressure along the pilot line 74. It is assumed, purely by way of example, that the cross-sectional area of the rod 42 is uniformly one-eighth of the cross-sectional area of the piston 26. The rate of fluid flow from the lower port 34 is thus reduced to about one-eighth of the flow rate otherwise required. The balance of the fluid that would otherwise be discharged from the lower chamber 30 to the tank 84 flows directly through the flow passages 52 of the piston 26 to the upper chamber 28, to meet flow requirements for expansion of the upper chamber 28.

The second mode of operation relates to pressing of a work piece and follows the first mode of operation. In the second mode of operation, the flow gating valve 88 directs hydraulic fluid under pressure to the upper port 32 of the hydraulic cylinder 14 and couples the lower port 34 to the tank 84. The biasing springs 66 displace the valve member 56 to its flow-disabling orientation (closed valve state), and the hydraulic cylinder 14 then operates essentially as a conventional cylinder, driving the upper platen 10 downwardly. In this compression phase of operation, the upper platen 10 normally displaces through only a limited distance over an extended period of time, and flow rates to and from the cylinder chambers 28, 30 are comparatively small.

The third mode of operation relates to upward displacement of the platen 10 following compression of a work piece. As a preliminary step, the flow gating valve 88 may momentarily couple the upper cylinder chamber 28 to the tank 84 to relieve pressure within the upper chamber 28. The flow gating valve 88 then obstructs fluid flow from the upper port 32 of the hydraulic cylinder 14. It directs hydraulic fluid under pressure along the pilot line 74 to displace the valve member 56 to its flow-enabling orientation, placing the upper and lower chambers 28, 30 in communication. It also directs hydraulic fluid under pressure to the lower port 34 of the hydraulic cylinder 14. The net upward displacing force produced by the hydraulic cylinder 14 is a function of the applied pressure and the effective cross-sectional area of the rod 42. This would be sufficient to raise even a fairly substantial platen in most applications. No hydraulic fluid is required to flow from the upper chamber 28 which is being contracted. Assuming the same parameters as above, the pressurized fluid flow to the lower chamber 30 is reduced to only one-eighth of the flow rate normally required. The balance of fluid required for expansion of the lower chamber 30 is obtained by direct flow from the upper chamber 28 to the lower chamber 30, through the piston's flow passages 52.

The operation of the press 6 has been described with reference to only one cylinder 14. It will be appreciated that both cylinders 14, 16 are operated simultaneously in an analogous manner. In that regard, the flow gating valve 88 is coupled to the upper and lower ports of the other cylinder 16 in an identical manner. The flow gating valve 88 effectively operates on sets of upper ports, lower ports and internal pilot lines of the two cylinders 14, 16. The operation of the flow gating valve 88 may be controlled in a conventional manner with a microprocessor or programmable logic array and appropriate pressure and platen spacing sensors.

Figure 5A:
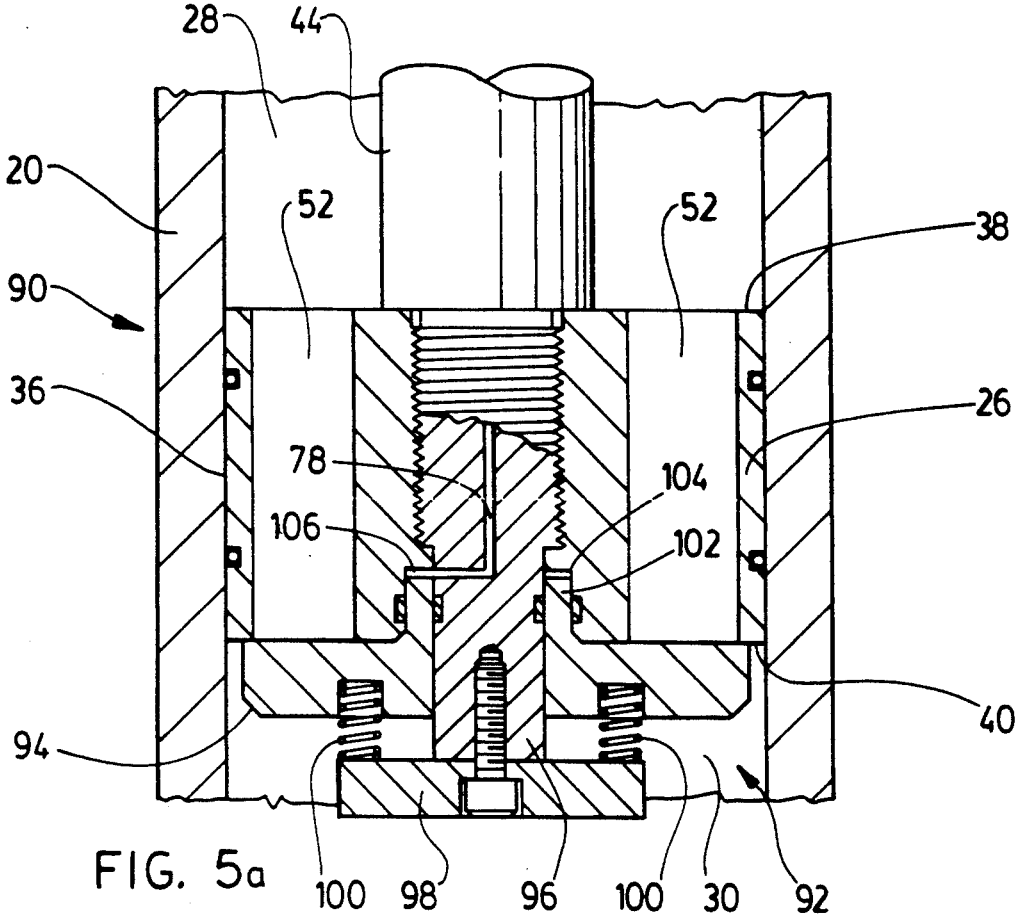
FIGS. 5*a* and 5*b* are enlarged views in partial cross-section of a piston and internal valve of a second hydraulic cylinder with the valve respectively in closed and open states; and, FIGS. 6*a* and 6*b* are enlarged views in partial cross-section of a piston and internal valve of a third hydraulic cylinder with the valve respectively in closed and open states.
Figure 5B:
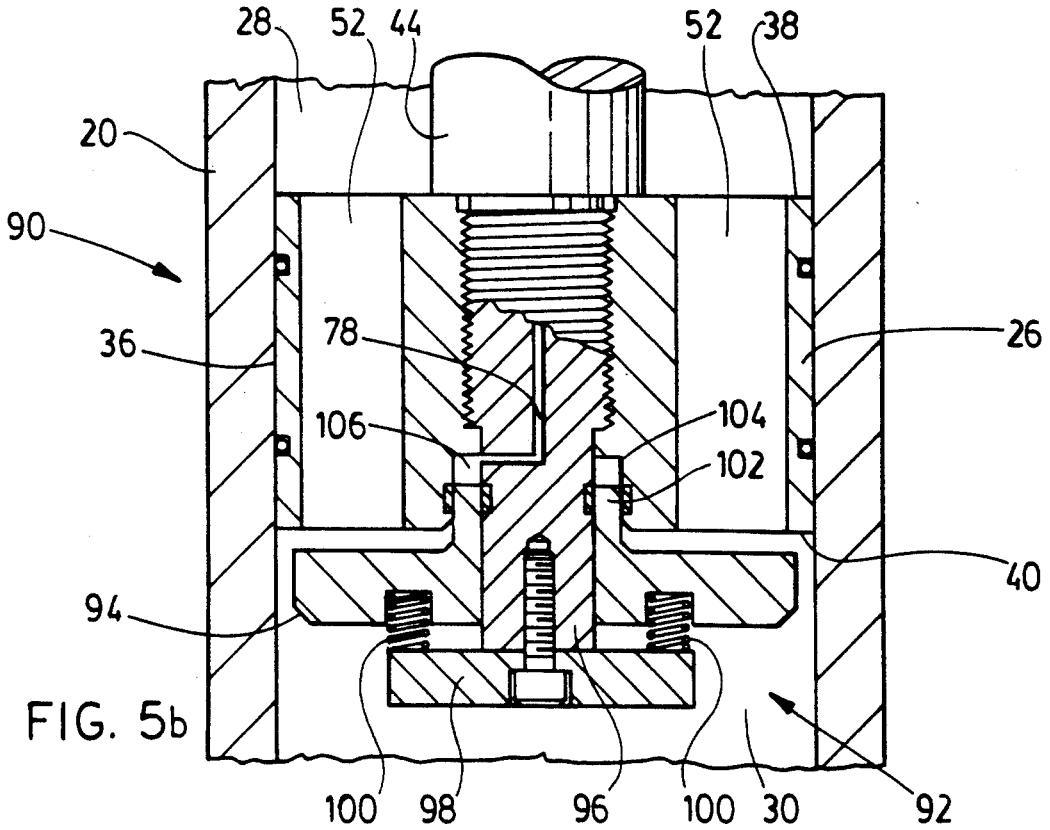

A hydraulic cylinder 90 with a modified valve 92 is shown in FIGS. 5*a* and 5*b*. Components similar to those of the cylinder 14 have been indicated with the same reference numerals. It should be noted that the cylinder 90 is not appropriate for incorporation into the down-acting press 6 of FIG. 1, since the associated valve 92 cannot remain closed during down-acting compression phases of operation.

The valve 92 of the hydraulic cylinder 90 comprises a valve member 94 located in the lower chamber 30. The rod 42 extends downwardly to define a projection 96 from the lower face 40 of the piston 26. An abutment 98 for biasing springs 100 is bolted to the lower end of the projection 96. A sleeve portion 102 of the valve member 94 is mounted about the projection 96 and seated in a complementary recess 104 formed in the lower piston face 40. The valve member 94 consequently displaces along the lengthwise axis of the rod 42 between a flow-disabling orientation (FIG. 5*a*) in conforming engagement with the lower piston face 40 and a flow-enabling orientation displaced from the lower piston face 40. The valve member 94 is displaced to its flow-enabling orientation in response to hydraulic fluid along the pilot line 74, which now communicates with an annular compartment 106 formed in the piston 26 immediately above the end face of the sleeve portion 102. The valve member 94 is restored to its flow-disabling orientation by the biasing springs 100.

The following difference in operation relative to the cylinder 14 of FIG. 2. should be noted. First, if fluid flow is to be enabled between the upper and lower chambers 28, 30 during cylinder contraction, the valve member 94 must be hydraulically displaced to its flow-enabling orientation. Second, with the valve member 94 spring-biased to its closed state, the full cross-sectional area of the piston 26 is effectively available for application of pressure to expand the cylinder 90 rather than just the rod cross-section.

Figure 6A:
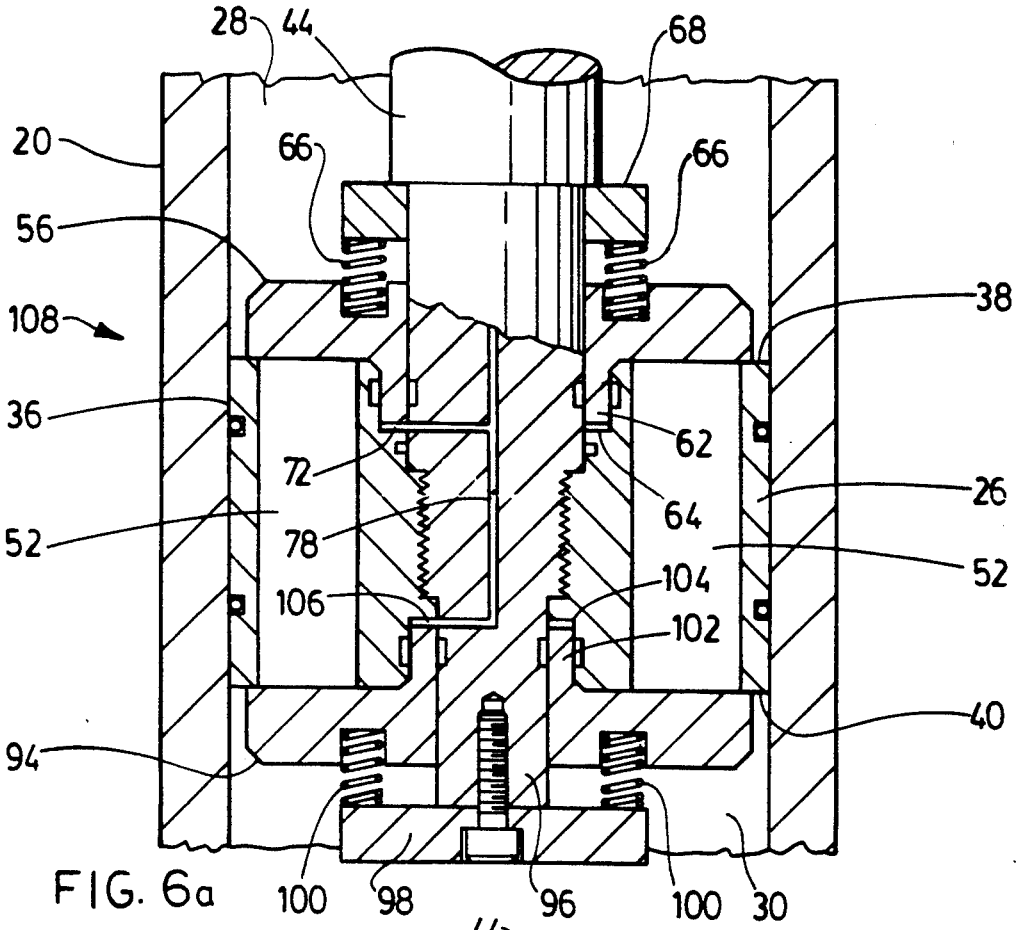
Figure 6B:
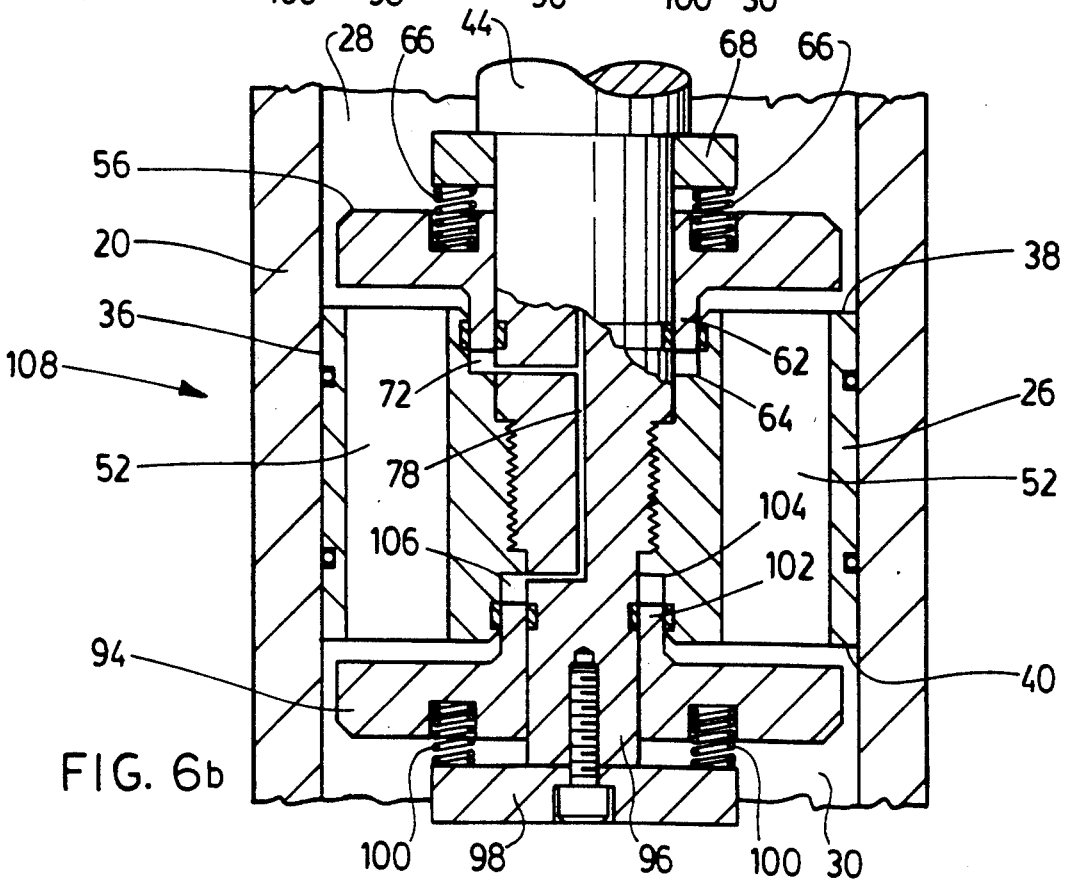

FIGS. 6*a* and 6*b* illustrate yet another hydraulic cylinder 108. The differences relative to the cylinders 14 and 90 relate to the construction of a valve 110 mounted on the piston 26. This hydraulic cylinder 108 involves a combination of components found in the previous two cylinders, which components have consequently been illustrated with identical reference numerals. This version can be used with the down-acting press 6 of FIG. 1.

In the third hydraulic cylinder 108, the valve 110 comprises both valve members 56, 94 described above. The pilot line 74 now communicates with both compartments 72, 106 in the piston 26, allowing for simultaneous displacement of the valve members 56, 94 to their flow-enabling orientations (as in FIG. 6*b*). The biasing springs 66, 100 tend to turn to return the two valve members 56, 94 to their flow-disabling orientation (as in FIG. 6*a*).

The valve 110 of the third cylinder 108 does not assume an open state in response to pressure in either chamber 28 or 30. Accordingly, the hydraulic cylinder 108 can be operated as a conventional double-acting hydraulic cylinder of comparable construction that has no internal flow channels and flow control valve. However, hydraulic fluid under pressure must be applied to pilot line 74 whenever fluid is to be transferred directly between the upper and lower chambers 28, 30. For example, in the first mode of operation of the down-acting press 6, namely, rapid advance of the upper platen 10 downwardly, the valve 110 would have to be hydraulically activated to assume its open state. The second and third modes of operation, namely, compression of a work piece and rapid retraction upwardly of the upper platen 10, would remain essentially the same.

It will be appreciated that particular embodiments of the invention have been described and that modifications may be made therein without departing from the spirit of the invention or necessarily departing from the scope of the appended claims.

I claim:

1. A press comprising:

a frame;

a lower platen fixed to the frame;

a moveable upper platen;

a plurality of hydraulic cylinders, each of the hydraulic cylinders comprising:

(a) a housing with an interior, the housing being fixed to one of the frame and the lower platen;

(b) a piston and rod assembly comprising a piston displaceable within the interior of the housing and a rod fixed to and displaceable with the piston, the piston dividing the interior of the housing into upper and lower chambers, the piston comprising upper and lower opposing faces located respectively at the upper and lower chambers, the rod extending upwardly from the piston and comprising an upper rod portion external to the housing interior and attached to the upper platen;

(c) an upper fluid port attached to the housing and accessing the upper chamber;

(d) a lower fluid port attached to the housing and accessing the lower chamber;

(e) a passage formed in the piston and extending between the upper and lower piston faces;

(f) valve means attached to and displaceable with the piston and rod assembly for controlling fluid flow along the passage, the valve means having an open state permitting fluid flow along the passage and a closed state impeding fluid flow along the passage; and, (g) control means for controlling the state of the valve means, the control means extending from the valve means through the piston and rod assembly to the external rod portion such that the control means are operable from externally of the housing;

a reservoir containing hydraulic fluid;

means coupled to the reservoir for producing hydraulic fluid under pressure;

controllable fluid gating means comprising at least first, second and third selectable modes of operation, the fluid gating means in the first mode of operation directing no hydraulic fluid under pressure to the upper ports of the hydraulic cylinders and coupling the lower ports of the hydraulic cylinders to the reservoir, the fluid gating means in the second mode of operation directing the hydraulic fluid under pressure to the upper ports of the hydraulic cylinders and coupling the lower ports of the hydraulic cylinders to the reservoir, and the fluid gating means in the third selectable mode of operation directing the hydraulic fluid under pressure to the lower ports of the hydraulic cylinders and obstructing fluid flow from the upper ports of the hydraulic cylinders.

2. The press of claim 1 in which in each of the hydraulic cylinders:

the control means comprise a channel for hydraulic fluid formed in the rod, the channel communicating with the valve means and comprising an inlet formed in the external rod portion;

the valve means assume the open state in response to the hydraulic fluid under pressure in the channel; and, the fluid gating means in the third mode of operation direct the hydraulic fluid under pressure along the hydraulic fluid passage.

3. The press of claim 1 in which in each of the hydraulic cylinders the valve means comprise:

a valve member located in the upper chamber;

means mounting the valve member to the piston and rod assembly for displacement along a lengthwise axis through the rod between a flow-impeding orientation in which the valve member abuts the upper piston face and an flow-enabling orientation in which the valve member is displaced from the upper piston face; and biasing means acting between the piston and rod assembly and the valve member for urging the valve member to displace axially toward its flow-disabling orientation.

4. The press of claim 3 in which in each of the hydraulic cylinders:

the valve member comprises a body portion conforming to the first face and a sleeve portion surrounding the rod and extending transversely from the body portion toward the piston;

the piston comprises a recess that receives the sleeve portion for relative sliding and that defines a compartment between an end face of the sleeve portion distant from the body portion and the piston; and, the control means comprise a channel for hydraulic fluid formed in the rod, the channel communicating with the compartment and comprising an inlet formed in the external rod portion.

5. The press of claim 1 in which the valve means comprise:

a first valve member;

a second valve member means supporting the first valve member for; displacement along a lengthwise axis through the rod between a flow-impeding orientation against the first piston face and a flow-enabling orientation spaced from the first piston face;

means supporting the second valve member for displacement along the lengthwise axis between a flow-impeding orientation against the second piston face and a flow-enabling orientation spaced from the second piston face; and, biasing means for urging each of the first and second valve members axially toward its respective flow-impeding orientation.

6. The hydraulic cylinder of claim 5 in which the control means comprise a channel for hydraulic fluid formed in the rod, the channel communicating with each of the valve members and comprising an inlet formed in the external rod portion.

7. A hydraulic cylinder comprising:

a housing with an interior;

a piston and rod assembly comprising a piston displaceable within the interior of the housing and a rod fixed to and displaceable with the piston, the piston dividing the interior of the housing into first and second chambers, the piston comprising first and second opposing faces located respectively at the first and second chambers and comprising a recess formed in the first face, the rod comprising a rod portion external to the housing interior;

a first fluid port attached to the housing and accessing the first chamber;

a second fluid port attached to the housing and accessing the second chamber;

a passage formed in the piston and extending between the first and second piston faces;

valve means attached to and displaceable with the piston and rod assembly for controlling fluid flow along the passage between the chambers, the valve means having an open state permitting fluid flow along the passage and a closed state impeding fluid flow along the passage, the valve means including a valve member comprising a body portion located in the first chamber and conforming to the first piston face and comprising a sleeve portion surrounding the rod and extending in relative sliding relationship into the recess of the piston such that the valve member is displaceable along a lengthwise axis through the rod between a flow-impeding orientation in which the body portion of the valve member abuts the first piston face and a flow-enabling orientation in which the body portion of the valve member is displaced from the first piston face, and biasing means for urging the valve member to displace axially towards its flow-impeding orientation;

a compartment within the piston recess, the compartment being defined between the piston and an end face of the sleeve portion which is distant from the body portion of the valve member; and, control means for controlling the state of the valve means, the control means comprising a channel for hydraulic fluid formed in the rod, the channel communicating with the compartment and comprising an inlet formed in the external rod portion such that the control means are operable from externally of the housing.

8. The hydraulic cylinder of claim 7 in which the biasing means comprise:

an abutment member fixed to the rod with the body portion of the valve member between the first face of the piston and the abutment member; and, at least one spring extending between the abutment member and the body portion of the valve member.

9. A hydraulic cylinder comprising:

a housing with an interior;

a piston and rod assembly comprising a piston displaceable within the interior of the housing and a rod fixed to and displaceable with the piston, the piston dividing the interior of the housing into first and second chambers, the piston comprising first and second opposing faces located respectively at the first and second chambers, the rod comprising a rod portion external to the housing interior;

a first fluid port attached to the housing and accessing the first chamber;

a second fluid port attached to the housing and accessing the second chamber;

a passage formed in the piston and extending between the first and second piston faces;

valve means attached to an displaceable with the piston and rod assembly for controlling fluid flow along the passage between the chambers, the valve means having an open state permitting fluid flow along the passage and a closed state impeding fluid flow along the passage, the valve means comprising a first valve member, a second valve member, means supporting the first valve member for displacement along a lengthwise axis through the rod between a flow-impeding orientation against the first piston face and a flow-enabling orientation spaced from the first piston face, means supporting the second valve member for displacement along the lengthwise axis between a flow-impeding orientation against the second piston face and a flow-enabling orientation spaced from the second piston face, and biasing means for urging each of the first and second valve members axially towards its respective flow-impeding orientation; and, control means for controlling the state of the valve means, the control means extending from the valve means through the piston and rod assembly to the external rod portion such that the control means are operable from externally of the housing.

10. The hydraulic cylinder of claim 9 in which the control means comprise a channel for hydraulic fluid formed in the rod, the channel communicating with each of the valve members and comprising an inlet formed in the external rod portion.

11. The hydraulic cylinder of claim 10 in which:

the rod extends from the first piston face and the piston comprises a central projection extending from the second piston face;

the first valve member comprises a body portion conforming to the first piston face and a sleeve portion surrounding the rod and extending transversely from the body portion toward the piston;

the piston comprises a first recess that receives the sleeve portion of the first valve member for relative sliding;

the second valve member comprises a body portion conforming to the second piston face and a sleeve portion surrounding the projection and extending transversely from the body portion of the second valve member toward the piston;

the piston comprises a second recess that receives the sleeve portion of the second valve member for relative sliding;

the piston defines a first internal compartment at an end face of the sleeve portion of the first valve member and a second internal compartment at an end face of the sleeve portion of the second valve member; and, the channel communicates with each of the first and second compartments.

12. The hydraulic cylinder of claim 11 in which the biasing means comprise:

a first abutment member fixed to the rod;

a second abutment member fixed to the projection;

at least one spring extending between the first abutment member and the body portion of the first valve member; and, at least one spring extending between the second abutment member and the body portion of the second valve member.

* * * * *